US008554126B2

(12) United States Patent
Kikuchi

(10) Patent No.: US 8,554,126 B2
(45) Date of Patent: Oct. 8, 2013

(54) IMAGE FORMING APPARATUS

(75) Inventor: Nobuhiro Kikuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 74 days.

(21) Appl. No.: 13/248,866

(22) Filed: Sep. 29, 2011

(65) Prior Publication Data

US 2012/0099876 A1 Apr. 26, 2012

(30) Foreign Application Priority Data

Oct. 20, 2010 (JP) ..... 2010-235488

(51) Int. Cl.
*G03G 15/00* (2006.01)

(52) U.S. Cl.
USPC ..... 399/405; 399/397

(58) Field of Classification Search
CPC ..... G03G 2215/00421
USPC ..... 399/397, 70
See application file for complete search history.

(56) References Cited

U.S. PATENT DOCUMENTS 6,788,905 B2 * 9/2004 Tsutada ..... 399/45
2008/0203964 A1 * 8/2008 Koike ..... 318/799

FOREIGN PATENT DOCUMENTS

JP 2002-268305 9/2002

* cited by examiner

*Primary Examiner* — Matthew G Marini
*Assistant Examiner* — John M Royston
(74) *Attorney, Agent, or Firm* — Canon USA, Inc., IP Division

(57) ABSTRACT

An image forming apparatus includes: a fixing device configured to fix the toner image to the sheet by heat; a discharge tray onto which the sheet to which the toner image has been fixed by the fixing device is discharged; a discharge device configured to convey the sheet so as to discharge the sheet onto the discharge tray; and a controller configured to temporarily stop the discharge device conveying the sheet while the sheet is being discharged by the discharge device and to resume the discharge device conveying the sheet after a predetermined stop time has elapsed, the controller controls the discharge device such that the conveyance torque of the discharge device at a time of resuming the discharge device conveying the sheet is larger than the conveyance torque of the discharge device before temporarily stopping the discharge device conveying the sheet.

16 Claims, 5 Drawing Sheets

IMAGE FORMING APPARATUS

BACKGROUND OF THE INVENTION

1. Field of the Invention

The present invention relates to an image forming apparatus configured to fix a developing material to a sheet by using a heat-fixing device and, in particular, to discharge control of the sheet which has passed through the heat-fixing device in such an image forming apparatus.

2. Description of the Related Art

In an image forming apparatus employing electrophotography, represented by a laser beam printer and a copying machine, a toner image transferred onto a sheet is fixed to the sheet by using a heat-fixing device and the sheet is discharged onto a discharge tray. As a result of the recent increase in speed in image forming apparatuses, the sheet heated by the fixing device is discharged onto the discharge tray before the sheet has been sufficiently cooled. Thus, the sheets stacked on the discharge tray pile up without the toner thereon being sufficiently cooled, resulting in a drawback that the sheets stick to each other. In view of this, Japanese Patent Application Laid-Open No. 2002-268305 discusses a technique in which before a sheet is stacked on discharge tray, the sheet is temporarily stopped during the course of discharge, and a part thereof is exposed to the exterior of the apparatus or cooled by cooling air from a cooling apparatus to thereby sufficiently cool the toner thereon, subsequently the conveyance resumes and the sheet is stacked on the discharge tray. In this way, the sheets are prevented from sticking to each other.

However, in the case where the conveyance of the sheet is temporarily stopped at the discharge unit to cool the sheet, the leading edge portion of the sheet at rest trails down, so that the sheet is stopped while in contact with the preceding sheet stacked on the discharge tray. FIG. 5 is a schematic diagram illustrating how the sheet conveyance is temporarily stopped at the discharge unit of a printer.

When the leading edge of a sheet 14 to be discharged onto a discharge tray 15 is detected by a discharge sensor 13, the conveyance of the sheet being discharged with a predetermined timing is temporarily stopped. In this case, the sheet 14 stops in the state as illustrated in FIG. 5, and the leading edge of the sheet 14 comes into contact with a sheet 16 already stacked on the discharge tray 15 at a position 17.

When again conveying the sheet 14 temporarily kept at rest, there is exerted a maximum static friction force at the position 17 where the sheet 14 is held in contact with the sheet 16. This maximum static friction force is a resistance force larger than the dynamic friction force that would be exerted when discharging the sheet without temporarily stopping the conveyance. As a result, there is a possibility of the leading edge of the sheet 14 being caught by the sheet 16 discharged and stacked on the discharge tray 15, resulting in a defective stacking of the sheet 14; or there is a possibility of the discharge sensor 13 erroneously detecting a fully stacked state when in reality the stacking tray is not fully stacked.

It might be possible to temporarily stop the conveyance before the leading edge of the sheet 14 comes into contact with the sheet 16; in this case, however, the major portion of the sheet 14 would remain inside the apparatus, disabling to achieve a sufficient cooling effect.

SUMMARY OF THE INVENTION

The present invention is directed to an image forming apparatus which allows sheets to be discharged and stacked in a normal fashion without involving any defective conveyance even in a case in which the conveyance of a sheet is temporarily stopped at the discharge unit for the purpose of cooling or the like and then the conveyance is resumed to discharge the sheet to the exterior of the apparatus.

According to an aspect of the present invention, an image forming apparatus includes: an image forming device configured to form a toner image on a sheet; a fixing device configured to fix the toner image formed by the image forming device to the sheet by heat; a discharge tray onto which the sheet to which the toner image has been fixed by the fixing device is discharged; a discharge device configured to convey the sheet so as to discharge it onto the discharge tray; and a controller configured to temporarily stop the conveyance of the sheet while the sheet is being discharged by the discharge device and to resume the conveyance of the sheet after a predetermined stop time has elapsed; wherein the controller controls the discharge device such that the conveyance torque of the discharge device when resuming the conveyance of the sheet is larger than the conveyance torque of the discharge device before temporarily stopping the conveyance of the sheet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
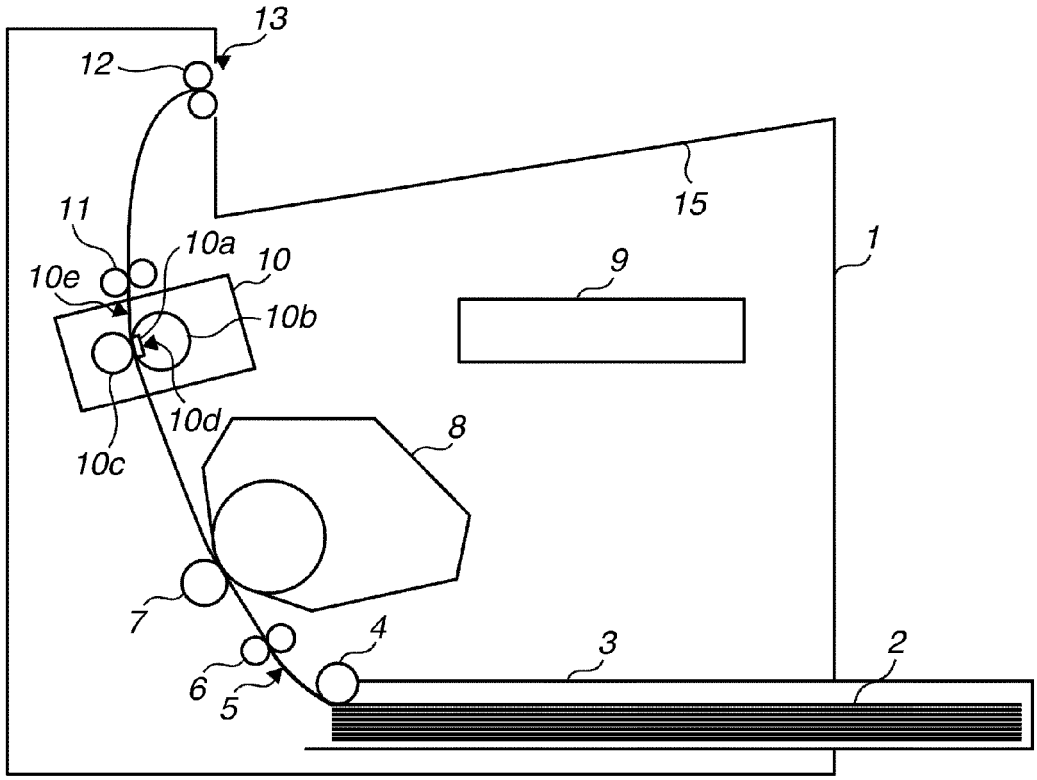
FIG. 1 is a sectional view illustrating the construction of an image forming apparatus.

FIG. 1 is a sectional view illustrating the construction of a laser beam printer 1 constituting an image forming apparatus to which the present invention is applicable. Sheets 2 accommodated in a cassette 3 are fed one by one by a pick-up roller 4 to be conveyed to registration rollers 6. Between the pick-up roller 4 and the registration rollers 6, there is provided a conveyance sensor 5, which detects each sheet 2 conveyed from the pick-up roller 4.

An image forming unit 8 forms an electrostatic latent image by a laser beam emitted from a laser scanner unit 9, developing the electrostatic latent image with toner. The sheet 2 having been conveyed to the registration rollers 6 is temporarily stopped, and is conveyed to a transfer roller 7 by the registration rollers 6 in synchronization with the image formation at the image forming unit 8. The toner image formed at the image forming unit 8 is transferred to the sheet 2 by the transfer roller 7, and the sheet 2 is conveyed to a fixing device 10. The sheet 2 which has undergone fixing processing is conveyed by fix/discharge rollers 11 and discharge rollers 12, and is discharged onto a discharge tray 15. A sensor 13 configured to detect fully stacked state of the sheets is arranged on the discharge tray 15. In addition to the fully stacked state detection, the sensor 13 also serves to detect the leading edge of the sheet 2 discharged by the discharge rollers 12.

The fixing device 10 will be illustrated in detail. The fixing device 10 includes a fixing film 10*b* within which a heater 10*a* is arranged, a pressurizing roller 10*c* forming a fixing nip together with the heater 10*a* and configured to transmit drive to the fixing film 10*b*, and a fix/discharge sensor 10*e* monitoring the conveyance of the sheet 2. The heater 10*a* heats the fixing film 10*b* at the fixing nip portion. The heater 10*a* is provided with a temperature sensor 10*d* (e.g., a thermistor) in contact with the heater 10*a* for monitoring temperature. According to the temperature of the heater 10*a* as measured by the temperature sensor 10*d*, a temperature control circuit (not illustrated) controls the supply of electricity to the heater 10*a* such that the heater 10*a* attains a predetermined temperature.

Figure 2:
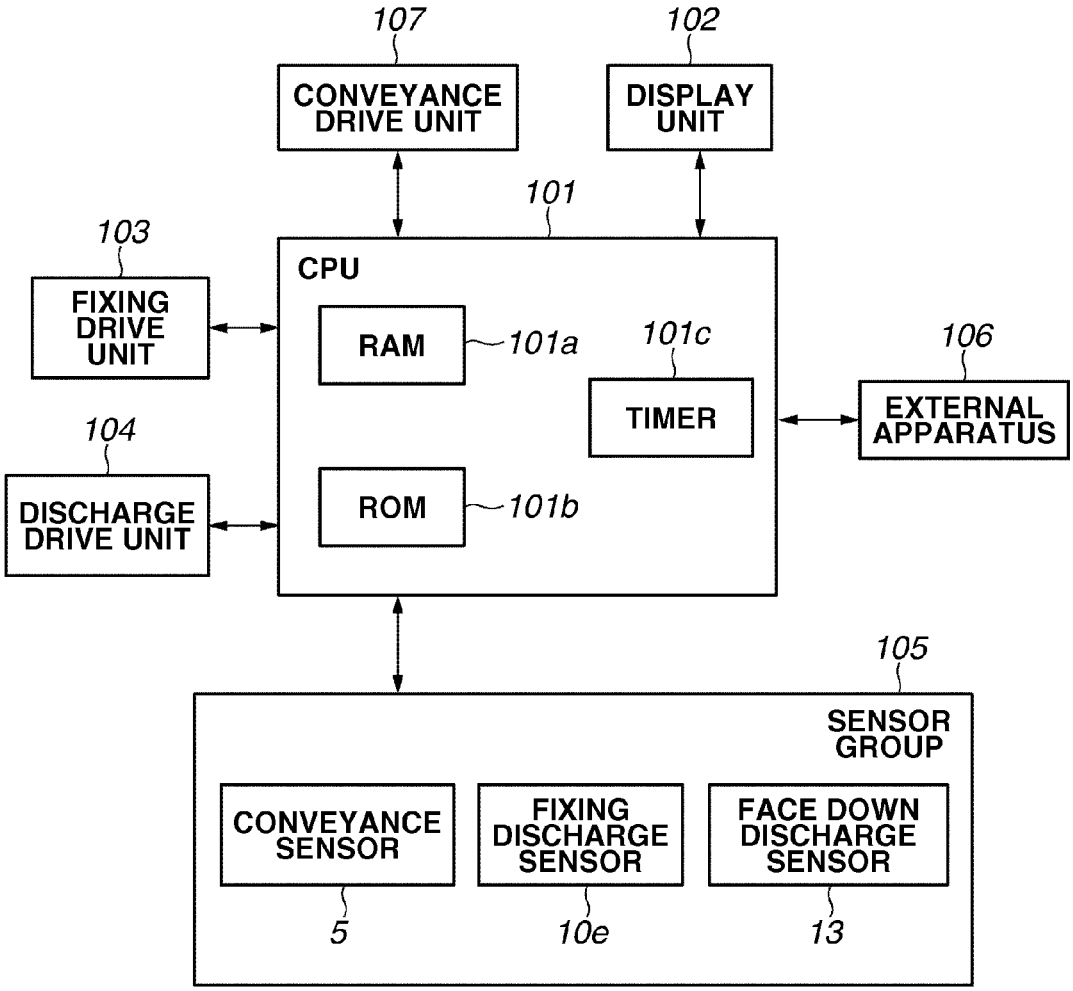
FIG. 2 is a block diagram illustrating the electrical system configuration of the image forming apparatus.

FIG. 2 is a block diagram illustrating the electrical system configuration of the printer 1. A central processing unit (CPU) configured to control the operation of the printer 1 includes a read-only memory (ROM) 101*a*, a random-access memory RAM 101*b*, and a timer 101*c*. The CPU 101 includes a display unit 102, a fixing drive unit 103, a conveyance drive unit 107, a discharge drive unit 104, and a sensor group 105, and is endowed with a function by which it communicates with an external apparatus 106. The CPU 101 exchanges with the display unit 102 to display an operation panel and receive operation input. Further, the CPU 101 controls the fixing drive unit 103 to control the fixing temperature. Further, the CPU 101 controls the conveyance drive unit 107 and the discharge drive unit 104 to control the sheet conveyance, and receives an input signal from the sensor group 105 to monitor the sheet conveyance condition on the conveyance path and to specify the sheet position on the conveyance path. The discharge drive unit includes a DC motor driven by a pulse-width modulation signal (PWM signal); as illustrated below, the duty ratio of the PWM signal is controlled by the CPU 101, whereby the conveyance torque is controlled.

Figure 3:
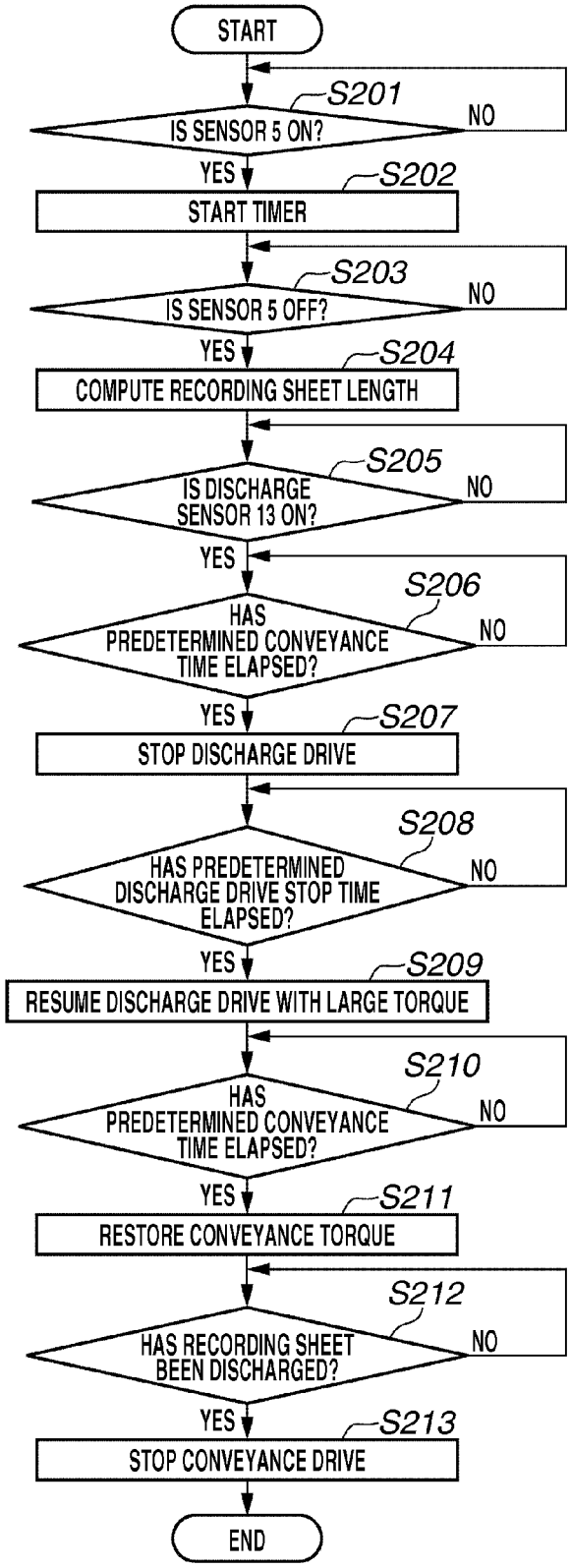
FIG. 3 is a flowchart illustrating a sheet conveyance processing.

FIG. 3 is a flowchart illustrating the sheet conveyance processing executed by the CPU 101. First, in step S201, the CPU 101 waits for the detection by the sensor 5 of the sheet 2 fed from the cassette 3. In step S202, when the sensor 5 is turned on upon detecting the leading edge of the sheet 2, the CPU 101 starts the built-in timer 101*c*. Next, in step S203, the CPU 101 waits for the sensor 5 to be turned off. In step S204, when the sensor 5 is turned off upon detecting the trailing edge of the sheet 2, the CPU 101 stops the timer 101*c*, and determines the length L of the sheet 2 from the time Ton that the sensor 5 has been on and the conveyance speed Vs of the sheet 2. The length is determined from the following equation:

$$L = \mathrm{Ton} \times Vs$$

In the present exemplary embodiment, the speed Vs at which the sheet 2 is conveyed is 105 mm/sec. Thus, when the sensor 5 has been on, for example, for 2 seconds, the length L of the sheet 2 is computed as 210 mm.

In step S205, when the length of the sheet 2 has been determined, the CPU 101 waits for the discharge sensor 13 to be turned on. In step S206, when the discharge sensor 13 detects the leading edge of the sheet and is turned on, the CPU 101 waits for a predetermined period of time to elapse, and, in step S207, when the predetermined period of time has elapsed, temporarily stops the conveyance of the sheet 2 being discharged. This predetermined period of time is determined according to the length of the sheet (in the conveyance direction); the longer the sheet length, the longer the predetermined period of time. For example, when the sheet length is 210 mm (A4 size), the discharge roller 12 is stopped such that the trailing edge portion of the sheet is left in the apparatus by 20 mm. In other words, when approximately 1.81 seconds have elapsed after the discharge sensor 13 has been turned on, the CPU 101 stops the driving of the discharge roller 12. After this, in step S208, the CPU 101 waits for the predetermined stop time of the discharge roller 12 to elapse; in step S209, after the predetermined stop time has elapsed, it resumes the driving of the discharge roller 12 with a torque larger than the conveyance torque before the stopping of the discharge roller 12. In the present exemplary embodiment, the temporary stop time for the discharge roller 12 is 2.0 seconds. In the present exemplary embodiment, the sheet conveyance interval when printing is continuously performed on a plurality of sheets is 2.3 seconds; the temporary stop time is set such that even if the discharge roller 12 temporarily stops, the sheet temporarily kept at rest and the subsequent sheet do not collide with each other.

To attain a torque larger than that before the stopping when resuming the conveyance, the present exemplary embodiment employs a PWM-controlled DC motor in the discharge drive unit 104, which is the drive unit for the discharge roller 12. In step S210, the CPU 101 waits for a predetermined period of time to elapse after the conveyance is resumed. In step S211, when the predetermined period of time has elapsed, the CPU 101 controls the discharge drive unit 104 such that the torque of the DC motor attains the conveyance torque before the conveyance stopping operation. After this, in step S212, the CPU 101 waits for the discharge sensor 13 to be turned off; when the discharge sensor 13 is turned off (YES in step S212), in step S213, the CPU 101 stops the discharge roller 12. When there exists a subsequent sheet, the driving of the discharge roller 12 is continued.

Figure 4:
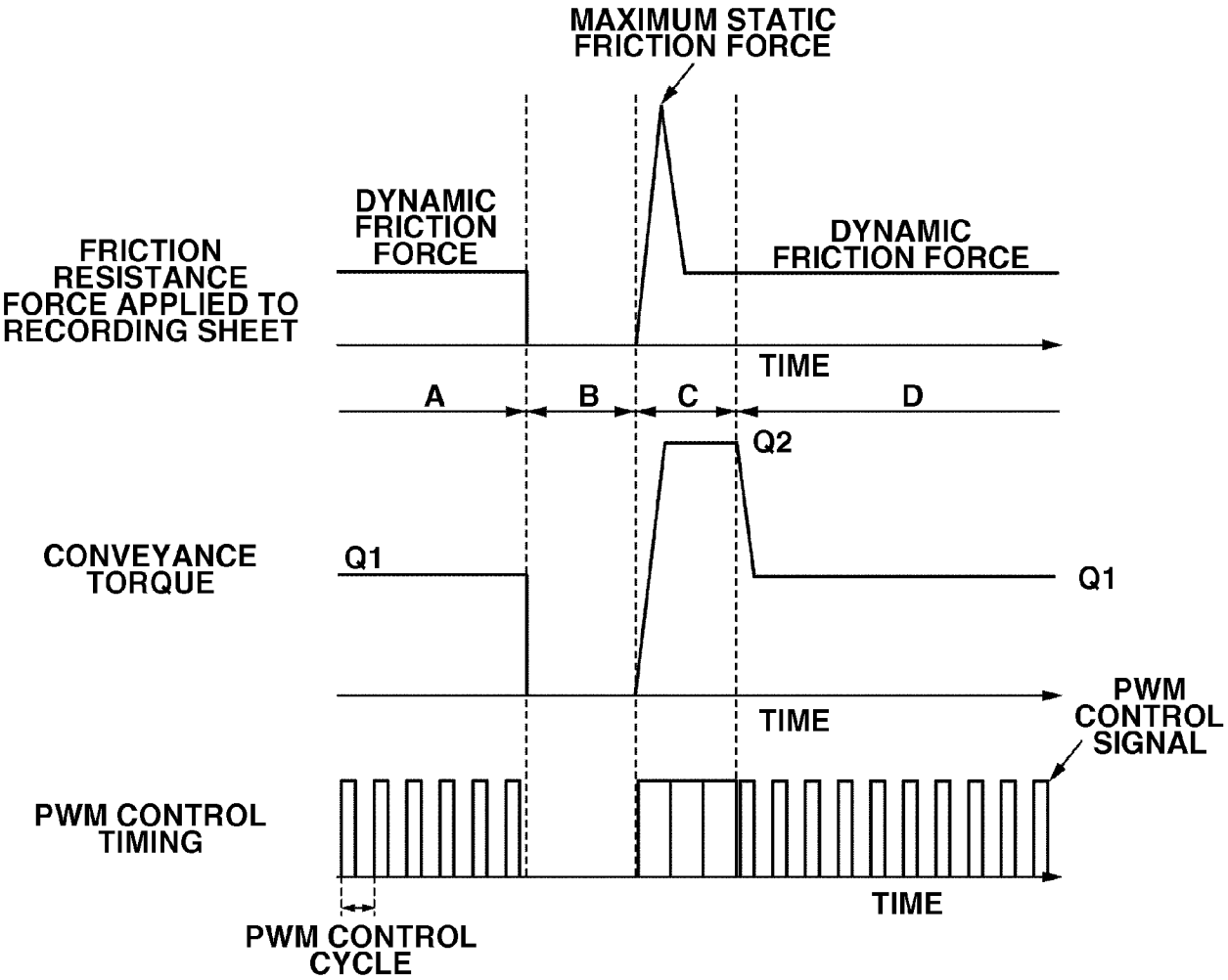
FIG. 4 is a time chart illustrating a friction resistance force exerted on a sheet, a conveyance torque, and a pulse-width modulation (PWM) control timing for a motor.
Figure 5:
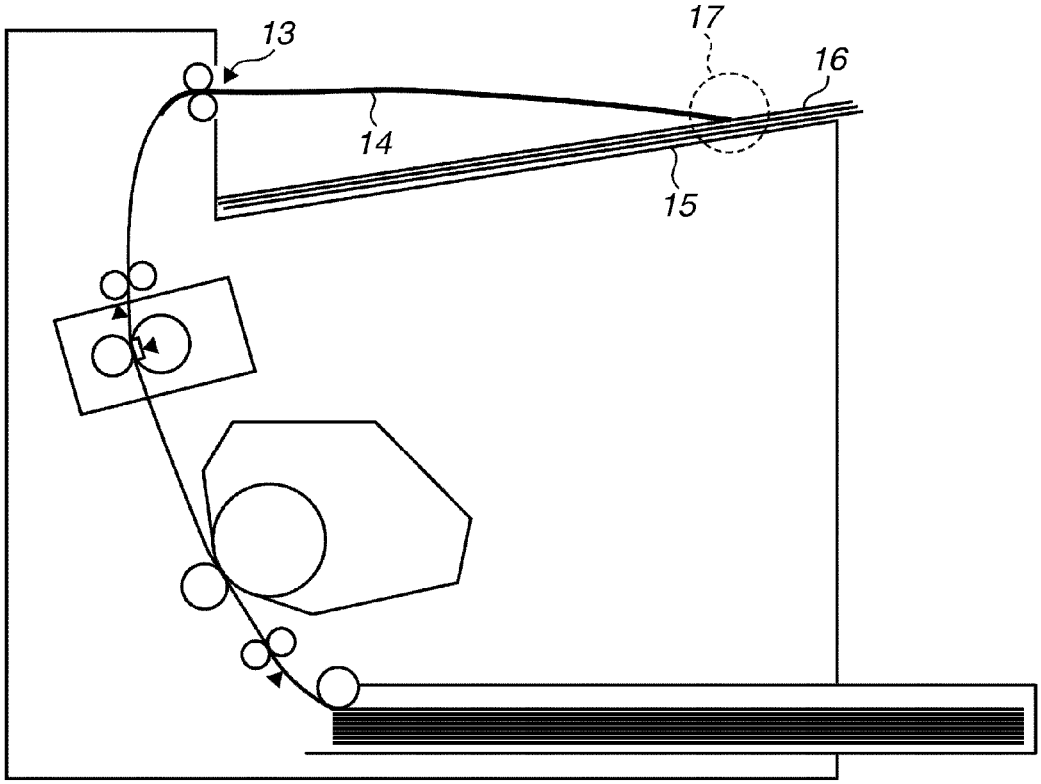
FIG. 5 is a schematic diagram illustrating the problem.

FIG. 4 illustrates the friction resistance force applied to the sheet 2, the conveyance torque, and the PWM control timing for the DC motor. In the diagram, the period indicated by symbol A is a state before the conveyance of the sheet being discharged is temporarily stopped. The friction resistance force applied to the sheet 2 is a dynamic friction force, and the conveyance torque is set to a torque Q1, which is not less than the dynamic friction force. In this case, the duty ratio in the PWM control of the DC motor is 50%. In the diagram, the PWM-signal-on width with respect to the PWM control cycle indicates the control value. In the diagram, the period indicated by symbol B is a state in which the conveyance of the sheet being discharged is temporarily stopped. The PWM control value is 0%, and the driving of the DC motor is stopped. In the diagram, the period indicated by symbol C is a state during which the conveyance of the sheet is resumed. The friction resistance force applied to the sheet 2 is the maximum static friction force, which is a peak immediately before the sheet 2 starts to move with respect to the sheets already stacked on the discharge tray 15. The requisite conveyance torque is Q2, which is larger than the above-mentioned maximum static friction force. If the conveyance torque when the conveyance is resumed is not more than the maximum static friction force, there is a possibility of the conveyance of the sheet 2 being hindered, making it impossible to perform normal discharge or stacking. In view of this, the PWM control value of the DC motor is set to 100% to generate the conveyance torque Q2, which is not less than the maximum static friction force. As a result, the conveyance is resumed without involving hindrance of the conveyance of the sheet due to friction force. In the diagram, the period indicated by symbol D corresponds to a state in which the PWM control value of the DC motor is restored to 50% from 100%. The torque Q2 in excess of the maximum static friction force is required only when the sheet starts to move, whereas the former torque Q1 suffices after the sheet has started to move. If the torque Q2 is maintained even after the sheet has started to move, there is generated a difference in conveyance speed as compared with the fixing discharge roller 11 and the fixing device 10 at the point in time when the subsequent sheet reaches the discharge roller 12, resulting in unevenness in fixing, wrinkles in the sheet, etc. In view of this, during the period D, the DC motor is controlled such that the conveyance torque is restored to Q1.

As illustrated above, even in the case in which the conveyance of the sheet being discharged is temporarily stopped to cool the sheet, the conveyance is resumed with a conveyance torque larger than the resistance force due to the maximum static friction force exerted on the sheet when the conveyance is resumed, whereby it is possible to prevent defective sheet conveyance and to perform normal sheet discharge.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-235488 filed Oct. 20, 2010, which is hereby incorporated by reference herein in its entirety.

What is claimed is:

1. An image forming apparatus comprising:

an image forming device configured to form a toner image on a sheet;

a fixing device configured to fix the toner image formed by the image forming device to the sheet by heat;

a discharge tray onto which the sheet to which the toner image has been fixed by the fixing device is discharged;

a discharge device configured to convey the sheet to discharge the sheet onto the discharge tray using a sheet conveyance torque, wherein the sheet conveyance torque includes at least a first sheet conveyance torque and a second sheet conveyance torque; and a controller configured to stop the sheet by temporarily stopping the discharge device conveying the sheet while the sheet is being discharged by the discharge device and to resume conveying the sheet after temporarily stopping the discharge device conveying the sheet by resuming the discharge device conveying the sheet after a predetermined stop time has elapsed, wherein the controller controls the discharge device to convey the sheet such that the second sheet conveyance torque used to convey the sheet after resuming the discharge device conveying the sheet (i) is larger than the first sheet conveyance torque used while conveying the sheet before temporarily stopping the discharge device conveying the sheet and (ii) is applied to convey the sheet for a predetermined period of time to reduce a possibility of a leading edge of the sheet from being caught by a sheet in the discharge tray.

2. The image forming apparatus according to claim 1, wherein, after increasing the sheet conveyance torque from the first sheet conveyance torque to the second sheet conveyance torque, the controller continues the discharge of the sheet by restoring the sheet conveyance torque to the first sheet conveyance torque used before the discharge device was temporarily stopped.

3. The image forming apparatus according to claim 1, wherein the second sheet conveyance torque is a torque in excess of a maximum static friction force applied between the discharged sheet and a sheet stacked on the discharge tray.

4. The image forming apparatus according to claim 1, further comprising a sensor configured to detect the sheet discharged by the discharge device, wherein the controller temporarily stops the conveyance of the sheet in response to a predetermined period of time elapsing after a leading edge of the sheet is detected by the sensor.

5. The image forming apparatus according to claim 1, wherein the discharge device includes a motor driven by a pulse-width modulation signal, and wherein, to resume the conveyance of the sheet, the controller increases the sheet conveyance torque from the first sheet conveyance torque to the second sheet conveyance torque by increasing a duty ratio of the pulse-width modulation signal from the duty ratio used before the discharge device was temporarily stopped.

6. The image forming apparatus according to claim 1, wherein the second sheet conveyance torque is applied for at least three pulse-width modulation (PWM) control cycles to reduce a possibility of a leading edge of the sheet from being caught by a sheet in the discharge tray.

7. The image forming apparatus according to claim 1, wherein the predetermined stop time is set such that, even if the discharge device temporarily stops, the sheet temporarily kept at rest and a subsequent sheet do not collide with each other.

8. The image forming apparatus according to claim 5, wherein the duty ratio of the pulse-width modulation signal is increased to 100% from the duty ratio used while conveying the sheet before the discharge device was temporarily stopped.

9. A method comprising:

presenting an image forming apparatus having a controller, an image forming device configured to form a toner image on a sheet, a fixing device configured to fix the toner image formed by the image forming device to the sheet by heat, a discharge tray onto which the sheet to which the toner image has been fixed by the fixing device is discharged, and a discharge device configured to convey the sheet to discharge the sheet onto the discharge tray using a sheet conveyance torque, wherein the sheet conveyance torque includes at least a first sheet conveyance torque and a second sheet conveyance torque;

stopping the sheet by using the controller to temporarily stop the discharge device conveying the sheet while the sheet is being discharged by the discharge device; and resuming conveying the sheet after temporarily stopping the discharge device conveying the sheet by using the controller to resume the discharge device conveying the sheet after a predetermined stop time has elapsed, wherein resuming conveying the sheet includes controlling the discharge device to convey the sheet such that the second sheet conveyance torque used to convey the sheet after resuming the discharge device conveying the sheet (i) is larger than the first sheet conveyance torque used while conveying the sheet before temporarily stopping the discharge device conveying the sheet and (ii) is applied to convey the sheet for a predetermined period of time to reduce a possibility of a leading edge of the sheet from being caught by a sheet in the discharge tray.

10. The method according to claim 9, wherein, after increasing the sheet conveyance torque from the first sheet conveyance torque to the second sheet conveyance torque, the controller continues the discharge of the sheet by restoring the sheet conveyance torque to the first sheet conveyance torque used before the discharge device was temporarily stopped.

11. The method according to claim 9, wherein the second sheet conveyance torque is a torque in excess of a maximum static friction force applied between the discharged sheet and a sheet stacked on the discharge tray.

12. The method according to claim 9, wherein the image forming apparatus further includes a sensor configured to detect the sheet discharged by the discharge device, wherein temporarily stopping the conveyance of the sheet by the controller is in response to a predetermined period of time elapsing after a leading edge of the sheet is detected by the sensor.

13. The method according to claim 9, wherein the discharge device includes a motor driven by a pulse-width modulation signal, and wherein resuming the conveyance of the sheet by the controller includes increasing the sheet conveyance torque from the first sheet conveyance torque to the second sheet conveyance torque by increasing a duty ratio of the pulse-width modulation signal from the duty ratio used before the discharge device was temporarily stopped.

14. The method according to claim 9, wherein the second sheet conveyance torque is applied for at least three pulse-width modulation (PWM) control cycles to reduce a possibility of a leading edge of the sheet from being caught by a sheet in the discharge tray.

15. The method according to claim 9, wherein the predetermined stop time is set such that, even if the discharge device temporarily stops, the sheet temporarily kept at rest and a subsequent sheet do not collide with each other.

16. The method according to claim 13, wherein the duty ratio of the pulse-width modulation signal is increased to 100% from the duty ratio used while conveying the sheet before the discharge device was temporarily stopped.

* * * * *